US008194880B2

(12) United States Patent
Avendano

(10) Patent No.: US 8,194,880 B2
(45) Date of Patent: Jun. 5, 2012

(54) SYSTEM AND METHOD FOR UTILIZING OMNI-DIRECTIONAL MICROPHONES FOR SPEECH ENHANCEMENT

(75) Inventor: Carlos Avendano, Mountain View, CA (US)

(73) Assignee: Audience, Inc., Mountain View, CA (US)

( * ) Notice: Subject to any disclaimer, the term of this patent is extended or adjusted under 35 U.S.C. 154(b) by 1384 days.

(21) Appl. No.: 11/699,732

(22) Filed: Jan. 29, 2007

(65) Prior Publication Data

US 2008/0019548 A1 Jan. 24, 2008

Related U.S. Application Data

(63) Continuation-in-part of application No. 11/343,524, filed on Jan. 30, 2006.

(60) Provisional application No. 60/850,928, filed on Oct. 10, 2006.

(51) Int. Cl.
*H04R 3/00* (2006.01)

(52) U.S. Cl. ..... 381/92; 381/94.1; 381/94.2; 381/94.3; 381/94.7; 381/122; 704/226; 704/227; 704/233; 704/275

(58) Field of Classification Search ..... 381/313, 381/312, 91, 92, 122, 95, 110, 94.1, 94.2, 381/94.3, 94.7; 704/226, 227, 233, 275
See application file for complete search history.

(56) References Cited

U.S. PATENT DOCUMENTS

| | | | |
|---|---|---|---|
| 3,976,863 | A | 8/1976 | Engel |
| 3,978,287 | A | 8/1976 | Fletcher et al. |
| 4,137,510 | A | 1/1979 | Iwahara |
| 4,433,604 | A | 2/1984 | Ott |
| 4,516,259 | A | 5/1985 | Yato et al. |
| 4,535,473 | A | 8/1985 | Sakata |

(Continued)

FOREIGN PATENT DOCUMENTS

| | | |
|---|---|---|
| JP | 62110349 | 5/1987 |

(Continued)

OTHER PUBLICATIONS

Marc Moonen et al. "Multi-Microphone Signal Enhancement Techniques for Noise Suppression and Dereverberation," source(s): http://www.esat.kuleuven.ac.be/sista/yearreport97/node37.html.

Steven Boll et al. "Suppression of Acoustic Noise in Speech Using Two Microphone Adaptive Noise Cancellation", source(s): IEEE Transactions on Acoustic, Speech, and Signal Processing. vol. v ASSP-28, n 6, Dec. 1980, pp. 752-753.

(Continued)

*Primary Examiner* — Vivian Chin
*Assistant Examiner* — Paul Kim
(74) *Attorney, Agent, or Firm* — Carr & Ferrell LLP

(57) ABSTRACT

Systems and methods for utilizing inter-microphone level differences (ILD) to attenuate noise and enhance speech are provided. In exemplary embodiments, primary and secondary acoustic signals are received by omni-directional microphones, and converted into primary and secondary electric signals. A differential microphone array module processes the electric signals to determine a cardioid primary signal and a cardioid secondary signal. The cardioid signals are filtered through a frequency analysis module which takes the signals and mimics a cochlea implementation (i.e., cochlear domain). Energy levels of the signals are then computed, and the results are processed by an ILD module using a non-linear combination to obtain the ILD. In exemplary embodiments, the non-linear combination comprises dividing the energy level associated with the primary microphone by the energy level associated with the secondary microphone. The ILD is utilized by a noise reduction system to enhance the speech of the primary acoustic signal.

28 Claims, 9 Drawing Sheets

U.S. PATENT DOCUMENTS

| | | | |
|---|---|---|---|
| 4,536,844 | A | 8/1985 | Lyon |
| 4,581,758 | A | 4/1986 | Coker et al. |
| 4,628,529 | A | 12/1986 | Borth et al. |
| 4,630,304 | A | 12/1986 | Borth et al. |
| 4,649,505 | A | 3/1987 | Zinser, Jr. et al. |
| 4,658,426 | A | 4/1987 | Chabries et al. |
| 4,674,125 | A | 6/1987 | Carlson et al. |
| 4,718,104 | A | 1/1988 | Anderson |
| 4,811,404 | A | 3/1989 | Vilmur et al. |
| 4,812,996 | A | 3/1989 | Stubbs |
| 4,864,620 | A | 9/1989 | Bialick |
| 4,920,508 | A | 4/1990 | Yassaie et al. |
| 5,027,410 | A | 6/1991 | Williamson et al. |
| 5,054,085 | A | 10/1991 | Meisel et al. |
| 5,058,419 | A | 10/1991 | Nordstrom et al. |
| 5,099,738 | A | 3/1992 | Hotz |
| 5,119,711 | A | 6/1992 | Bell et al. |
| 5,142,961 | A | 9/1992 | Paroutaud |
| 5,150,413 | A | 9/1992 | Nakatani et al. |
| 5,175,769 | A | 12/1992 | Hejna, Jr. et al. |
| 5,187,776 | A | 2/1993 | Yanker |
| 5,208,864 | A | 5/1993 | Kaneda |
| 5,210,366 | A | 5/1993 | Sykes, Jr. |
| 5,224,170 | A | 6/1993 | Waite, Jr. |
| 5,230,022 | A | 7/1993 | Sakata |
| 5,319,736 | A | 6/1994 | Hunt |
| 5,323,459 | A | 6/1994 | Hirano |
| 5,341,432 | A | 8/1994 | Suzuki et al. |
| 5,381,473 | A | 1/1995 | Andrea et al. |
| 5,381,512 | A | 1/1995 | Holton et al. |
| 5,400,409 | A | 3/1995 | Linhard |
| 5,402,493 | A | 3/1995 | Goldstein |
| 5,402,496 | A | 3/1995 | Soli et al. |
| 5,471,195 | A | 11/1995 | Rickman |
| 5,473,702 | A | 12/1995 | Yoshida et al. |
| 5,473,759 | A | 12/1995 | Slaney et al. |
| 5,479,564 | A | 12/1995 | Vogten et al. |
| 5,502,663 | A | 3/1996 | Lyon |
| 5,544,250 | A | 8/1996 | Urbanski |
| 5,574,824 | A | 11/1996 | Slyh et al. |
| 5,583,784 | A | 12/1996 | Kapust et al. |
| 5,587,998 | A | 12/1996 | Velardo, Jr. et al. |
| 5,590,241 | A | 12/1996 | Park et al. |
| 5,602,962 | A | 2/1997 | Kellermann |
| 5,675,778 | A | 10/1997 | Jones |
| 5,682,463 | A | 10/1997 | Allen et al. |
| 5,694,474 | A | 12/1997 | Ngo et al. |
| 5,706,395 | A | 1/1998 | Arslan et al. |
| 5,717,829 | A | 2/1998 | Takagi |
| 5,729,612 | A | 3/1998 | Abel et al. |
| 5,732,189 | A | 3/1998 | Johnston et al. |
| 5,749,064 | A | 5/1998 | Pawate et al. |
| 5,757,937 | A | 5/1998 | Itoh et al. |
| 5,792,971 | A | 8/1998 | Timis et al. |
| 5,796,819 | A | 8/1998 | Romesburg |
| 5,806,025 | A | 9/1998 | Vis et al. |
| 5,809,463 | A | 9/1998 | Gupta et al. |
| 5,825,320 | A | 10/1998 | Miyamori et al. |
| 5,839,101 | A | 11/1998 | Vahatalo et al. |
| 5,920,840 | A | 7/1999 | Satyamurti et al. |
| 5,933,495 | A | 8/1999 | Oh |
| 5,943,429 | A | 8/1999 | Handel |
| 5,956,674 | A | 9/1999 | Smyth et al. |
| 5,974,380 | A | 10/1999 | Smyth et al. |
| 5,978,824 | A | 11/1999 | Ikeda |
| 5,983,139 | A | 11/1999 | Zierhofer |
| 5,990,405 | A | 11/1999 | Auten et al. |
| 6,002,776 | A | 12/1999 | Bhadkamkar et al. |
| 6,061,456 | A | 5/2000 | Andrea et al. |
| 6,072,881 | A | 6/2000 | Linder |
| 6,097,820 | A | 8/2000 | Turner |
| 6,108,626 | A | 8/2000 | Cellario et al. |
| 6,122,610 | A | 9/2000 | Isabelle |
| 6,134,524 | A | 10/2000 | Peters et al. |
| 6,137,349 | A | 10/2000 | Menkhoff et al. |
| 6,140,809 | A | 10/2000 | Doi |
| 6,173,255 | B1 | 1/2001 | Wilson et al. |
| 6,180,273 | B1 | 1/2001 | Okamoto |
| 6,216,103 | B1 | 4/2001 | Wu et al. |
| 6,222,927 | B1 | 4/2001 | Feng et al. |
| 6,223,090 | B1 | 4/2001 | Brungart |
| 6,226,616 | B1 | 5/2001 | You et al. |
| 6,263,307 | B1 | 7/2001 | Arslan et al. |
| 6,266,633 | B1 | 7/2001 | Higgins et al. |
| 6,317,501 | B1 | 11/2001 | Matsuo |
| 6,339,758 | B1 | 1/2002 | Kanazawa et al. |
| 6,355,869 | B1 | 3/2002 | Mitton |
| 6,363,345 | B1 | 3/2002 | Marash et al. |
| 6,381,570 | B2 | 4/2002 | Li et al. |
| 6,430,295 | B1 | 8/2002 | Handel et al. |
| 6,434,417 | B1 | 8/2002 | Lovett |
| 6,449,586 | B1 | 9/2002 | Hoshuyama |
| 6,469,732 | B1 | 10/2002 | Chang et al. |
| 6,487,257 | B1 | 11/2002 | Gustafsson et al. |
| 6,496,795 | B1 | 12/2002 | Malvar |
| 6,513,004 | B1 | 1/2003 | Rigazio et al. |
| 6,516,066 | B2 | 2/2003 | Hayashi |
| 6,529,606 | B1 | 3/2003 | Jackson, Jr. II et al. |
| 6,549,630 | B1 | 4/2003 | Bobisuthi |
| 6,584,203 | B2 | 6/2003 | Elko et al. |
| 6,622,030 | B1 | 9/2003 | Romesburg et al. |
| 6,717,991 | B1 | 4/2004 | Gustafsson et al. |
| 6,718,309 | B1 | 4/2004 | Selly |
| 6,738,482 | B1 | 5/2004 | Jaber |
| 6,760,450 | B2 | 7/2004 | Matsuo |
| 6,785,381 | B2 | 8/2004 | Gartner et al. |
| 6,792,118 | B2 | 9/2004 | Watts |
| 6,795,558 | B2 | 9/2004 | Matsuo |
| 6,798,886 | B1 | 9/2004 | Smith et al. |
| 6,810,273 | B1 | 10/2004 | Mattila et al. |
| 6,882,736 | B2 | 4/2005 | Dickel et al. |
| 6,915,264 | B2 | 7/2005 | Baumgarte |
| 6,917,688 | B2 | 7/2005 | Yu et al. |
| 6,944,510 | B1 | 9/2005 | Ballesty et al. |
| 6,978,159 | B2 | 12/2005 | Feng et al. |
| 6,982,377 | B2 | 1/2006 | Sakurai et al. |
| 6,999,582 | B1 | 2/2006 | Popovic et al. |
| 7,016,507 | B1 | 3/2006 | Brennan |
| 7,020,605 | B2 | 3/2006 | Gao |
| 7,031,478 | B2 | 4/2006 | Belt et al. |
| 7,054,452 | B2 | 5/2006 | Ukita |
| 7,065,485 | B1 | 6/2006 | Chong-White et al. |
| 7,076,315 | B1 | 7/2006 | Watts |
| 7,092,529 | B2 | 8/2006 | Yu et al. |
| 7,092,882 | B2 | 8/2006 | Arrowood et al. |
| 7,099,821 | B2 | 8/2006 | Visser et al. |
| 7,142,677 | B2 | 11/2006 | Gonopolskiy |
| 7,146,316 | B2 | 12/2006 | Alves |
| 7,155,019 | B2 | 12/2006 | Hou |
| 7,164,620 | B2 | 1/2007 | Hoshuyama |
| 7,171,008 | B2 | 1/2007 | Elko |
| 7,171,246 | B2 | 1/2007 | Mattila et al. |
| 7,174,022 | B1 | 2/2007 | Zhang et al. |
| 7,206,418 | B2 | 4/2007 | Yang et al. |
| 7,209,567 | B1 | 4/2007 | Kozel et al. |
| 7,225,001 | B1 | 5/2007 | Eriksson et al. |
| 7,242,762 | B2 | 7/2007 | He et al. |
| 7,246,058 | B2 | 7/2007 | Burnett |
| 7,254,242 | B2 | 8/2007 | Ise et al. |
| 7,359,520 | B2 | 4/2008 | Brennan et al. |
| 7,412,379 | B2 | 8/2008 | Taori et al. |
| 7,433,907 | B2 | 10/2008 | Nagai et al. |
| 7,555,434 | B2 | 6/2009 | Nomura et al. |
| 7,949,522 | B2 | 5/2011 | Hetherington et al. |
| 2001/0016020 | A1 | 8/2001 | Gustafsson et al. |
| 2001/0031053 | A1 | 10/2001 | Feng et al. |
| 2002/0002455 | A1 | 1/2002 | Accardi et al. |
| 2002/0009203 | A1 | 1/2002 | Erten |
| 2002/0041693 | A1 | 4/2002 | Matsuo |
| 2002/0080980 | A1 | 6/2002 | Matsuo |
| 2002/0106092 | A1 | 8/2002 | Matsuo |
| 2002/0116187 | A1 | 8/2002 | Erten |
| 2002/0133334 | A1 | 9/2002 | Coorman et al. |
| 2002/0147595 | A1 | 10/2002 | Baumgarte |
| 2002/0184013 | A1 | 12/2002 | Walker |
| 2003/0014248 | A1 | 1/2003 | Vetter |
| 2003/0026437 | A1 | 2/2003 | Janse et al. |

| | | | | |
|---|---|---|---|---|
| 2003/0033140 | A1 | 2/2003 | Taori et al. | |
| 2003/0039369 | A1 | 2/2003 | Bullen | |
| 2003/0040908 | A1 | 2/2003 | Yang et al. | |
| 2003/0061032 | A1 | 3/2003 | Gonopolskiy | |
| 2003/0063759 | A1 | 4/2003 | Brennan et al. | |
| 2003/0072382 | A1 | 4/2003 | Raleigh et al. | |
| 2003/0072460 | A1 | 4/2003 | Gonopolskiy et al. | |
| 2003/0095667 | A1 | 5/2003 | Watts | |
| 2003/0099345 | A1 | 5/2003 | Gartner et al. | |
| 2003/0101048 | A1 | 5/2003 | Liu | |
| 2003/0103632 | A1 | 6/2003 | Goubran et al. | |
| 2003/0128851 | A1 | 7/2003 | Furuta | |
| 2003/0138116 | A1 | 7/2003 | Jones et al. | |
| 2003/0147538 | A1* | 8/2003 | Elko | 381/92 |
| 2003/0169891 | A1* | 9/2003 | Ryan et al. | 381/92 |
| 2003/0228023 | A1 | 12/2003 | Burnett et al. | |
| 2004/0013276 | A1 | 1/2004 | Ellis et al. | |
| 2004/0047464 | A1 | 3/2004 | Yu et al. | |
| 2004/0057574 | A1 | 3/2004 | Faller | |
| 2004/0078199 | A1 | 4/2004 | Kremer et al. | |
| 2004/0131178 | A1 | 7/2004 | Shahaf et al. | |
| 2004/0133421 | A1 | 7/2004 | Burnett et al. | |
| 2004/0165736 | A1 | 8/2004 | Hetherington et al. | |
| 2004/0196989 | A1 | 10/2004 | Friedman et al. | |
| 2004/0263636 | A1 | 12/2004 | Cutler et al. | |
| 2005/0025263 | A1 | 2/2005 | Wu | |
| 2005/0027520 | A1 | 2/2005 | Mattila et al. | |
| 2005/0049864 | A1 | 3/2005 | Kaltenmeier et al. | |
| 2005/0060142 | A1 | 3/2005 | Visser et al. | |
| 2005/0152559 | A1 | 7/2005 | Gierl et al. | |
| 2005/0185813 | A1 | 8/2005 | Sinclair et al. | |
| 2005/0213778 | A1 | 9/2005 | Buck et al. | |
| 2005/0216259 | A1 | 9/2005 | Watts | |
| 2005/0228518 | A1 | 10/2005 | Watts | |
| 2005/0276423 | A1 | 12/2005 | Aubauer et al. | |
| 2005/0288923 | A1 | 12/2005 | Kok | |
| 2006/0072768 | A1 | 4/2006 | Schwartz et al. | |
| 2006/0074646 | A1 | 4/2006 | Alves et al. | |
| 2006/0098809 | A1 | 5/2006 | Nongpiur et al. | |
| 2006/0120537 | A1 | 6/2006 | Burnett et al. | |
| 2006/0133621 | A1 | 6/2006 | Chen et al. | |
| 2006/0149535 | A1 | 7/2006 | Choi et al. | |
| 2006/0184363 | A1 | 8/2006 | McCree et al. | |
| 2006/0198542 | A1 | 9/2006 | Benjelloun Touimi et al. | |
| 2006/0222184 | A1 | 10/2006 | Buck et al. | |
| 2007/0021958 | A1 | 1/2007 | Visser et al. | |
| 2007/0027685 | A1 | 2/2007 | Arakawa et al. | |
| 2007/0033020 | A1 | 2/2007 | Francois et al. | |
| 2007/0067166 | A1 | 3/2007 | Pan et al. | |
| 2007/0078649 | A1 | 4/2007 | Hetherington et al. | |
| 2007/0094031 | A1 | 4/2007 | Chen | |
| 2007/0100612 | A1 | 5/2007 | Ekstrand et al. | |
| 2007/0116300 | A1 | 5/2007 | Chen | |
| 2007/0150268 | A1 | 6/2007 | Acero et al. | |
| 2007/0154031 | A1 | 7/2007 | Avendano et al. | |
| 2007/0165879 | A1 | 7/2007 | Deng et al. | |
| 2007/0195968 | A1 | 8/2007 | Jaber | |
| 2007/0230712 | A1 | 10/2007 | Belt et al. | |
| 2007/0276656 | A1 | 11/2007 | Solbach et al. | |
| 2008/0033723 | A1 | 2/2008 | Jang et al. | |
| 2008/0140391 | A1 | 6/2008 | Yen et al. | |
| 2008/0201138 | A1 | 8/2008 | Visser et al. | |
| 2008/0228478 | A1 | 9/2008 | Hetherington et al. | |
| 2008/0260175 | A1 | 10/2008 | Elko | |
| 2009/0012783 | A1 | 1/2009 | Klein | |
| 2009/0012786 | A1 | 1/2009 | Zhang et al. | |
| 2009/0129610 | A1 | 5/2009 | Kim et al. | |
| 2009/0220107 | A1 | 9/2009 | Every et al. | |
| 2009/0238373 | A1 | 9/2009 | Klein | |
| 2009/0253418 | A1 | 10/2009 | Makinen | |
| 2009/0271187 | A1 | 10/2009 | Yen et al. | |
| 2009/0323982 | A1 | 12/2009 | Solbach et al. | |
| 2010/0094643 | A1 | 4/2010 | Avendano et al. | |
| 2010/0278352 | A1 | 11/2010 | Petit et al. | |
| 2011/0178800 | A1 | 7/2011 | Watts | |

FOREIGN PATENT DOCUMENTS

| | | |
|---|---|---|
| JP | 04184400 | 7/1992 |
| JP | 5053587 | 3/1993 |
| JP | 05-172865 | 7/1993 |
| JP | 06269083 | 9/1994 |
| JP | 10-313497 | 11/1998 |
| JP | 11-249693 | 9/1999 |
| JP | 2004053895 | 2/2004 |
| JP | 2004531767 | 10/2004 |
| JP | 2004533155 | 10/2004 |
| JP | 2005110127 | 4/2005 |
| JP | 2005148274 | 6/2005 |
| JP | 2005518118 | 6/2005 |
| JP | 2005195955 | 7/2005 |
| WO | 01/74118 | 10/2001 |
| WO | 02080362 | 10/2002 |
| WO | 02103676 | 12/2002 |
| WO | 03/043374 | 5/2003 |
| WO | 03/069499 | 8/2003 |
| WO | 2003069499 | 8/2003 |
| WO | 2004/010415 | 1/2004 |
| WO | 2007/081916 | 7/2007 |
| WO | 2007/140003 | 12/2007 |
| WO | 2010/005493 | 1/2010 |

OTHER PUBLICATIONS

Chen Liu et al. "A two-microphone dual delay-line approach for extraction of a speech sound in the presence of multiple interferers", source(s): Acoustical Society of America. vol. 110, Dec. 6, 2001, pp. 3218-3231.

Cohen et al. "Microphone Array Post-Filtering for Non-Stationary Noise", source(s): IEEE. May 2002.

Jingdong Chen et al. "New Insights into the Noise Reduction Wiener Filter", source(s): IEEE Transactions on Audio, Speech, and Langauge Processing. vol. 14, Jul. 4, 2006, pp. 1218-1234.

Rainer Martin et al. "Combined Acoustic Echo Cancellation, Dereverberation and Noise Reduction: A two Microphone Approach", source(s): Annales des Telecommunications/Annals of Telecommunications. vol. 29, Jul. 7-8-Aug. 1994, pp. 429-438.

Mitsunori Mizumachi et al. "Noise Reduction by Paired-Microphones Using Spectral Subtraction", source(s): 1998 IEEE. pp. 1001-1004.

Lucas Parra et al. "Convolutive blind Separation of Non-Stationary", source(s): IEEE Transactions on Speech and Audio Processing. vol. 8, May 3, 2008, pp. 320-327.

Isreal Cohen. "Multichannel Post-Filtering in Nonstationary Noise Environment", source(s): IEEE Transactions on Signal Processing. vol. 52, May 5, 2004, pp. 1149-1160.

R.A. Goubran. "Acoustic Noise Suppression Using Regressive Adaptive Filtering", source(s): 1990 IEEE. pp. 48-53.

Ivan Tashev et al. "Microphone Array of Headset with Spatial Noise Suppressor", source(s): http://research.microsoft.com/users/ivantash/Documents/Tashev_MAforHeadset_HSCMA_05.pdf. (4 pages).

Martin Fuchs et al. "Noise Suppression for Automotive Applications Based on Directional Information", source(s): 2004 IEEE. pp. 237-240.

Jean-Marc Valin et al. "Enhanced Robot Audition Based on Microphone Array Source Separation with Post-Filter", source(s): Proceedings of 2004 IEEE/RSJ International Conference on Intelligent Robots and Systems, Sep. 28-Oct. 2, 2004, Sendai, Japan. pp. 2123-2128.

Jont B. Allen. "Short Term Spectral Analysis, Synthesis, and Modification by Discrete Fourier Transform", IEEE Transactions on Acoustics, Speech, and Signal Processing. vol. ASSP-25, Jun. 3, 1977. pp. 235-238.

Jont B. Allen et al. "A Unified Approach to Short-Time Fourier Analysis and Synthesis", Proceedings of the IEEE. vol. 65, Nov. 11, 1977. pp. 1558-1564.

C. Avendano, "Frequency-Domain Techniques for Source Identification and Manipulation in Stereo Mixes for Enhancement, Suppression and Re-Panning Applications," in Proc. IEEE Workshop on Application of Signal Processing to Audio and Acoustics, Waspaa, 03, New Paltz, NY, 2003.

B. Widrow et al., "Adaptive Antenna Systems," Proceedings IEEE, vol. 55, No. 12, pp. 2143-2159, Dec. 1967.

Avendano, Carlos, "Frequency-Domain Source Identification and Manipulation in Stereo Mixes for Enhancement, Suppression and Re-panning Applications," 2003 IEEE Workshop on Applications of Signal Processing to Audio and Acoustics, Oct. 19-22, 2003, pp. 55-58, New Peitz, New York, USA.
Widrow, B. et al., "Adaptive Atenna Systems," Dec. 1967, pp. 2143-2159, vol. 55 No. 12, Proceedings of the IEEE.
Elko, Gary W., "Differential Microphone Arrays," Audio Signal Processing for Next-Generation Multimedia Communication Systems, 2004, pp. 12-65, Kluwer Academic Publishers, Norwell, Massachusetts, USA.
Boll, Steven F. "Suppression of Acoustic Noise in Speech using Spectral Subtraction", IEEE Transactions on Acoustics, Speech and Signal Processing, vol. ASSP-27, No. 2, Apr. 1979, pp. 113-120.
Boll, Steven F. "Suppression of Acoustic Noise in Speech Using Spectral Subtraction", Dept. of Computer Science, University of Utah Salt Lake City, Utah, Apr. 1979, pp. 18-19.
Dahl, Mattias et al., "Simultaneous Echo Cancellation and Car Noise Suppression Employing a Microphone Array", 1997 IEEE International Conference on Acoustics, Speech, and Signal Processing, Apr. 21-24, pp. 239-242.
"ENT 172." Instructional Module. Prince George's Community College Department of Engineering Technology. Accessed: Oct. 15, 2011. Subsection: "Polar and Rectangular Notation". <http://academic.ppgcc.edu/ent/ent172_instr_mod.html>.
Fulghum, D. P. et al., "LPC Voice Digitizer with Background Noise Suppression", 1979 IEEE International Conference on Acoustics, Speech, and Signal Processing, pp. 220-223.
Graupe, Daniel et al., "Blind Adaptive Filtering of Speech from Noise of Unknown Spectrum Using a Virtual Feedback Configuration", IEEE Transactions on Speech and Audio Processing, Mar. 2000, vol. 8, No. 2, pp. 146-158.
Haykin, Simon et al. "Appendix A.2 Complex Numbers." Signals and Systems. 2nd Ed. 2003. p. 764.
Hermansky, Hynek "Should Recognizers Have Ears?", in Proc. ESCA Tutorial and Research Workshop on Robust Speech Recognition for Unknown Communication Channels, pp. 1-10, France 1997.
Hohmann, V. "Frequency Analysis and Synthesis Using a Garnmatone Filterbank", ACTA Acustica United with Acustica, 2002, vol. 88, pp. 433-442.
Jeffress, Lloyd A. et al. "A Place Theory of Sound Localizcion," Journal of Comparative and Physiological Psychology, 1948, vol. 41, p. 35-39.
Jeong, Hyuk et al., "Implementation of a New Algorithm Using the STFT with Variable Frequency Resolution for the Time-Frequency Auditory Model", J. Audio Eng. Soc., Apr. 1999, vol. 47, No. 4., pp. 240-251.
Kates, James M. "A Time-Domain Digital Cochlear Model", IEEE Transactions on Signal Processing, Dec. 1991, vol. 39, No. 12, pp. 2573-2592.
Lazzaro, John et al., "A Silicon Model of Auditory Localization," Neural Computation Spring 1989, vol. 1, pp. 47-57, Massachusetts Institute of Technology.
Lippmann, Richard P. "Speech Recognition by Machines and Humans", Speech Communication, Jul. 1997, vol. 22, No. 1, pp. 1-15.
Martin, Rainer "Spectral Subtraction Based on Minimum Statistics", in Proceedings Europe. Signal Processing Conf., 1994, pp. 1182-1185.
Mitra, Sanjit K. Digital Signal Processing: a Computer-based Approach. 2nd Ed. 2001. pp. 131-133.
Watts, Lloyd Narrative of Prior Disclosure of Audio Display on Feb. 15, 2000 and May 31, 2000.
Cosi, Piero et al. (1996), "Lyon's Auditory Model Inversion: a Tool for Sound Separation and Speech Enhancement," Proceedings of ESCA Workshop on 'The Auditory Basis of Speech Perception,' Keele University, Keele (UK), Jul. 15-19, 1996, pp. 194-197.
Rabiner, Lawrence R. et al. "Digital Processing of Speech Signals", (Prentice-Hall Series in Signal Processing). Upper Saddle River, NJ: Prentice Hall, 1978.
Weiss, Ron et al., "Estimating Single-Channel Source Separation Masks: Revelance Vector Machine Classifiers vs. Pitch-Based Masking", Workshop on Statistical and Perceptual Audio Processing, 2006.
Schimmel, Steven et al., "Coherent Envelope Detection for Modulation Filtering of Speech," 2005 IEEE International Conference on Acoustics, Speech, and Signal Processing, vol. 1, No. 7, pp. 221-224.
Slaney, Malcom, "Lyon's Cochlear Model", Advanced Technology Group, Apple Technical Report #13, Apple Computer, Inc., 1988, pp. 1-79.
Slaney, Malcom, et al. "Auditory Model Inversion for Sound Separation," 1994 IEEE International Conference on Acoustics, Speech and Signal Processing, Apr. 19-22, vol. 2, pp. 77-80.
Slaney, Malcom. "An Introduction to Auditory Model Inversion", Interval Technical Report IRC 1994-014, http://coweb.ecn.purdue.edu/~maclom/interval/1994-014/, Sep. 1994, accessed on Jul. 6, 2010.
Solbach, Ludger "An Architecture for Robust Partial Tracking and Onset Localization in Single Channel Audio Signal Mixes", Technical University Hamburg-Harburg, 1998.
Stahl, V. et al., "Quantile Based Noise Estimation for Spectral Subtraction and Wiener Filtering," 2000 IEEE International Conference on Acoustics, Speech, and Signal Processing, Jun. 5-9, vol. 3, pp. 1875-1878.
Syntrillium Software Corporation, "Cool Edit Users Manual", 1996, pp. 1-74.
Tchorz, Jurgen et al., "SNR Estimation Based on Amplitude Modulation Analysis with Applications to Noise Suppression", IEEE Transactions on Speech and Audio Processing, vol. 11, No. 3, May 2003, pp. 184-192.
Watts, Lloyd, "Robust Hearing Systems for Intelligent Machines," Applied Neurosystems Corporation, 2001, pp. 1-5.
Yoo, Heejong et al., "Continuous-Time Audio Noise Suppression and Real-Time Implementation", 2002 IEEE International Conference on Acoustics, Speech, and Signal Processing, May 13-17, pp. IV3980-1V3983.
International Search Report dated Jun. 8, 2001 in Application No. PCT/US01/08372.
International Search Report dated Apr. 3, 2003 in Application No. PCT/US02/36946.
International Search Report dated May 29, 2003 in Application No. PCT/US03/04124.
International Search Report and Written Opinion dated Oct. 19, 2007 in Application No. PCT/US07/00463.
International Search Report and Written Opinion dated Apr. 9, 2008 in Application No. PCT/US07/21654.
International Search Report and Written Opinion dated Sep. 16, 2008 in Application No. PCT/US07/12628.
International Search Report and Written Opinion dated Oct. 1, 2008 in Application No. PCT/US08/08249.
International Search Report and Written Opinion dated May 11, 2009 in Application No. PCT/US09/01667.
International Search Report and Written Opinion dated Aug. 27, 2009 in Application No. PCT/US09/03813.
International Search Report and Written Opinion dated May 20, 2010 in Application No. PCT/US09/06754.
Fast Cochlea Transform, US Trademark Reg. No. 2,875,755 (Aug. 17, 2004).
Dahl, Mattias et al., "Acoustic Echo and Noise Cancelling Using Microphone Arrays", International Symposium on Signal Processing and its Applications, ISSPA, Gold coast, Australia, Aug. 25-30, 1996, pp. 379-382.
Demol, M. et al. "Efficient Non-Uniform Time-Scaling of Speech With WSOLA for CALL Applications", Proceedings of InSTIL/ICALL2004—NLP and Speech Technologies in Advanced Language Learning Systems—Venice Jun. 17-19, 2004.
Laroche, Jean. "Time and Pitch Scale Modification of Audio Signals", in "Applications of Digital Signal Processing to Audio and Acoustics", The Kluwer International Series in Engineering and Computer Science, vol. 437, pp. 279-309, 2002.
Moulines, Eric et al., "Non-Parametric Techniques for Pitch-Scale and Time-Scale Modification of Speech", Speech Communication, vol. 16, pp. 175-205, 1995.
Verhelst, Werner, "Overlap-Add Methods for Time-Scaling of Speech", Speech Communication vol. 30, pp. 207-221, 2000.

* cited by examiner

SYSTEM AND METHOD FOR UTILIZING OMNI-DIRECTIONAL MICROPHONES FOR SPEECH ENHANCEMENT

CROSS-REFERENCE TO RELATED APPLICATION

The present application claims the priority benefit of U.S. Provisional Patent Application No. 60/850,928, filed Oct. 10, 2006, and entitled "Array Processing Technique for Producing Long-Range ILD Cues with Omni-Directional. Microphone Pair;" the present application is also a continuation-in-part of U.S. patent application Ser. No. 11/343,524, filed Jan. 30, 2006 and entitled "System and Method for Utilizing Inter-Microphone Level Differences for Speech Enhancement," which claims the priority benefit of U.S. Provisional Patent Application No. 60/756,826, filed Jan. 5, 2006, and entitled "Inter-Microphone Level Difference Suppresor," all of which are herein incorporated by reference.

BACKGROUND OF THE INVENTION

1. Field of Invention

The present invention relates generally to audio processing and more. particularly to speech enhancement using inter-microphone level differences.

2. Description of Related Art

Currently, there are many methods for reducing background noise and enhancing speech in an adverse environment. One such method is to use two or more microphones on an audio device. These microphones are in prescribed positions and allow the audio device to determine a level difference between the microphone signals. For example, due to a space difference between the microphones, the difference in times of arrival of the signals from a speech source to the microphones may be utilized to localize the speech source. Once localized, the signals can be spatially filtered to suppress the noise originating from the different directions.

In order to take advantage of the level difference between two omni-directional microphones, a speech source needs to be closer to one of the microphones. That is, in order to obtain a significant level difference, a distance from the source to a first microphone needs to be shorter than a distance from the source to a second microphone. As such, a speech source must remain in relative closeness to the microphones, especially if the microphones are in close proximity as may be required by mobile telephony applications.

A solution to the distance constraint may be obtained by using directional microphones. Using directional microphones allows a user to extend an effective level difference between the two microphones over a larger range with a narrow inter-level difference (ILD) beam. This may be desirable for applications such as push-to-talk (PTT) or videophones where a speech source is not in as close a proximity to the microphones, as for example, a telephone application.

Disadvantageously, directional microphones have numerous physical drawbacks. Typically, directional microphones are large in size and do not fit well in small telephones or cellular phones. Additionally, directional microphones are difficult to mount as they required ports in order for sounds to arrive from a plurality of directions. Slight variations in manufacturing may result in a mismatch, resulting in more expensive manufacturing and production costs.

Therefore, it is desirable to utilize the characteristics of directional microphones in a speech enhancement system, without the disadvantages of using directional microphones, themselves.

SUMMARY OF THE INVENTION

Embodiments of the present invention overcome or substantially alleviate prior problems associated with noise suppression and speech enhancement. In general, systems and methods for utilizing inter-microphone level differences (ILD) to attenuate noise and enhance speech are provided. In exemplary embodiments, the ILD is based on energy level differences of a pair of omni-directional microphones.

Exemplary embodiments of the present invention use a non-linear process to combine components of the acoustic signals from the pair of omni-directional microphones in order to obtain the ILD. In exemplary embodiments, a primary acoustic signal is received by a primary microphone, and a secondary acoustic signal is received by a secondary microphone (e.g., omni-directional microphones). The primary and secondary acoustic signals are converted into primary and secondary electric signals for processing.

A differential microphone array (DMA) module processes the primary and secondary electric signals to determine a cardioid primary signal and a cardioid secondary signal. In exemplary embodiments, the primary and secondary electric signals are delayed by a delay node. The cardioid primary signal is then determined by taking a difference between the primary electric signal and the delayed secondary electric signal, while the cardioid secondary signal is determined by taking a difference between the secondary electric signal and the delayed primary electric signal. In various embodiments the delayed primary electric signal and the delayed secondary electric signal are adjusted by a gain. The gain may be a ratio between a magnitude of the primary acoustic signal and a magnitude of the secondary acoustic signal.

The cardioid signals are filtered through a frequency analysis module which takes the signals and mimics the frequency analysis of the cochlea (i.e., cochlear domain) simulated in this embodiment by a filter bank. Alternatively, other filters such as short-time Fourier transform (STFT), sub-band filter banks, modulated complex lapped transforms, cochlear models, wavelets, etc. can be used for the frequency analysis and synthesis. Energy levels associated with the cardioid primary signal and the cardioid secondary signals are then computed (e.g., as power estimates) and the results are processed by an ILD module using a non-linear combination to obtain the ILD. In exemplary embodiments, the non-linear combination comprises dividing the power estimate associated with the cardioid primary signal by the power estimate associated with the cardioid secondary signal. The ILD may then be used as a spatial discrimination cue in a noise reduction system to suppress unwanted sound sources and enhance the speech.

DESCRIPTION OF EXEMPLARY EMBODIMENTS

The present invention provides exemplary systems and methods for utilizing inter-microphone level differences (ILD) of at least two microphones to identify frequency regions dominated by speech in order to enhance speech and attenuate background noise and far-field distracters. Embodiments of the present invention may be practiced on any audio device that is configured to receive sound such as, but not limited to, cellular phones, phone handsets, headsets, and conferencing systems. Advantageously, exemplary embodiments are configured to provide improved noise suppression on small devices and in applications where the main audio source is far from the device. While some embodiments of the present invention will be described in reference to operation on a cellular phone, the present invention may be practiced on any audio device.

Figure 1A:
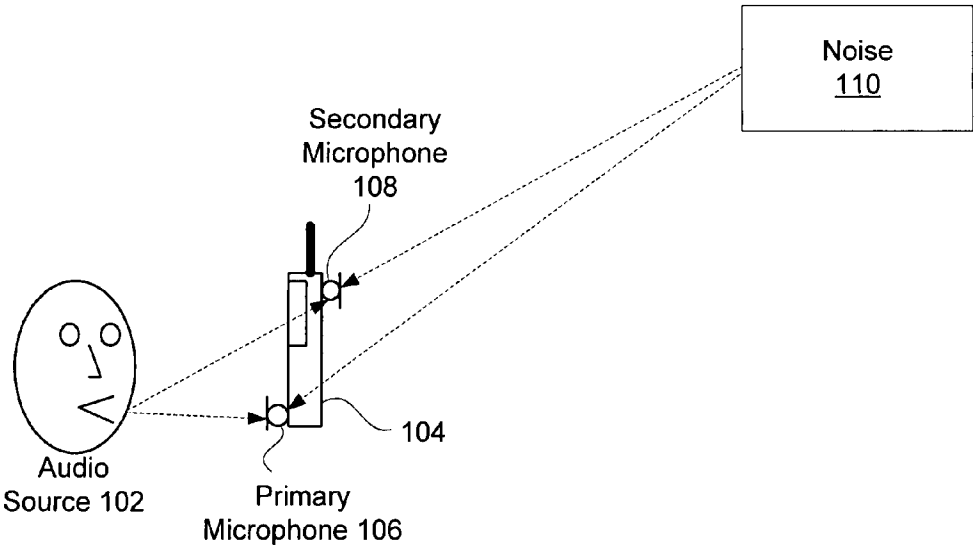
FIG. 1*a* and FIG. 1*b* are diagrams of two environments in which embodiments of the present invention may be practiced.
Figure 1B:
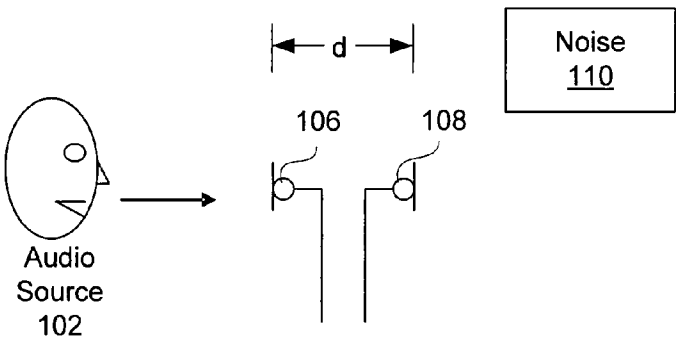

Referring to FIG. 1*a* and FIG. 1*b*, environments in which embodiments of the present invention may be practiced are shown. A user provides an audio (speech) source 102 to an audio device 104. The exemplary audio device 104 comprises two microphones: a primary microphone 106 relative to the audio source 102 and a secondary microphone 108 located a distance, d, away from the primary microphone 106. In exemplary embodiments, the microphones 106 and 108 are omni-directional microphones.

While the microphones 106 and 108 receive sound (i.e., acoustic signals) from the audio source 102, the microphones 106 and 108 also pick up noise 110. Although the noise 110 is shown coming from a single location in FIG. 1*a* and FIG. 1*b*, the noise 110 may comprise any sounds from one or more locations different than the audio source 102, and may include reverberations and echoes.

Embodiments of the present invention exploit level differences (e.g., energy differences) between the acoustic signals received by the two microphones 106 and 108 independent of how the level differences are obtained. In FIG. 1*a*, because the primary microphone 106 is much closer to the audio source 102 than the secondary microphone 108, the intensity level is higher for the primary microphone 106 resulting in a larger energy level during a speech/voice segment, for example. In FIG. 1*b*, because directional response of the primary microphone 106 is highest in the direction of the audio source 102 and directional response of the secondary microphone 108 is lower in the direction of the audio source 102, the level difference is highest in the direction of the audio source 102 and lower elsewhere.

The level difference may then be used to discriminate speech and noise in the time-frequency domain. Further embodiments may use a combination of energy level differences and time delays to discriminate speech. Based on binaural cue decoding, speech signal extraction, or speech enhancement may be performed.

Figure 2:
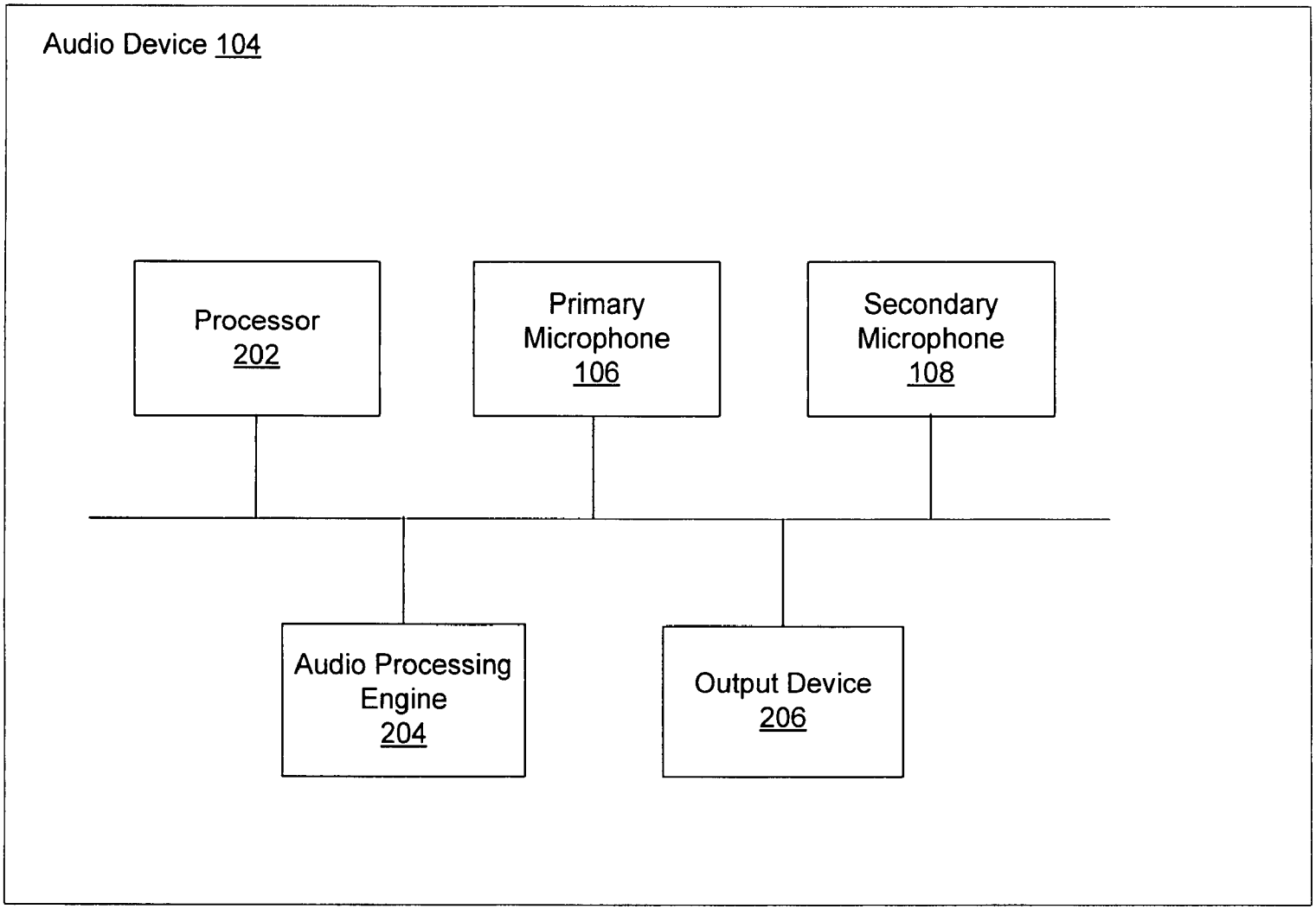
FIG. 2 is a block diagram of an exemplary audio device implementing embodiments of the present invention.

Referring now to FIG. 2, the exemplary audio device 104 is shown in more detail. In exemplary embodiments, the audio device 104 is an audio receiving device that comprises a processor 202, the primary microphone 106, the secondary microphone 108, an audio processing engine 204, and an output device 206. The audio device 104 may comprise further components necessary for audio device 104 operations. The audio processing engine 204 will be discussed in more detail in connection with FIG. 3.

As previously discussed, the primary and secondary microphones 106 and 108, respectively, are spaced a distance apart in order to allow for an energy level differences between them. Upon reception by the microphones 106 and 108, the acoustic signals are converted into electric signals (i.e., a primary electric signal and a secondary electric signal). The electric signals may themselves be converted by an analog-to-digital converter (not shown) into digital signals for processing in accordance with some embodiments. In order to differentiate the acoustic signals, the acoustic signal received by the primary microphone 106 is herein referred to as the primary acoustic signal, while the acoustic signal received by the secondary microphone 108 is herein referred to as the secondary acoustic signal.

The output device 206 is any device which provides an audio output to the user. For example, the output device 206 may be an earpiece of a headset or handset, or a speaker on a conferencing device.

Figure 3:
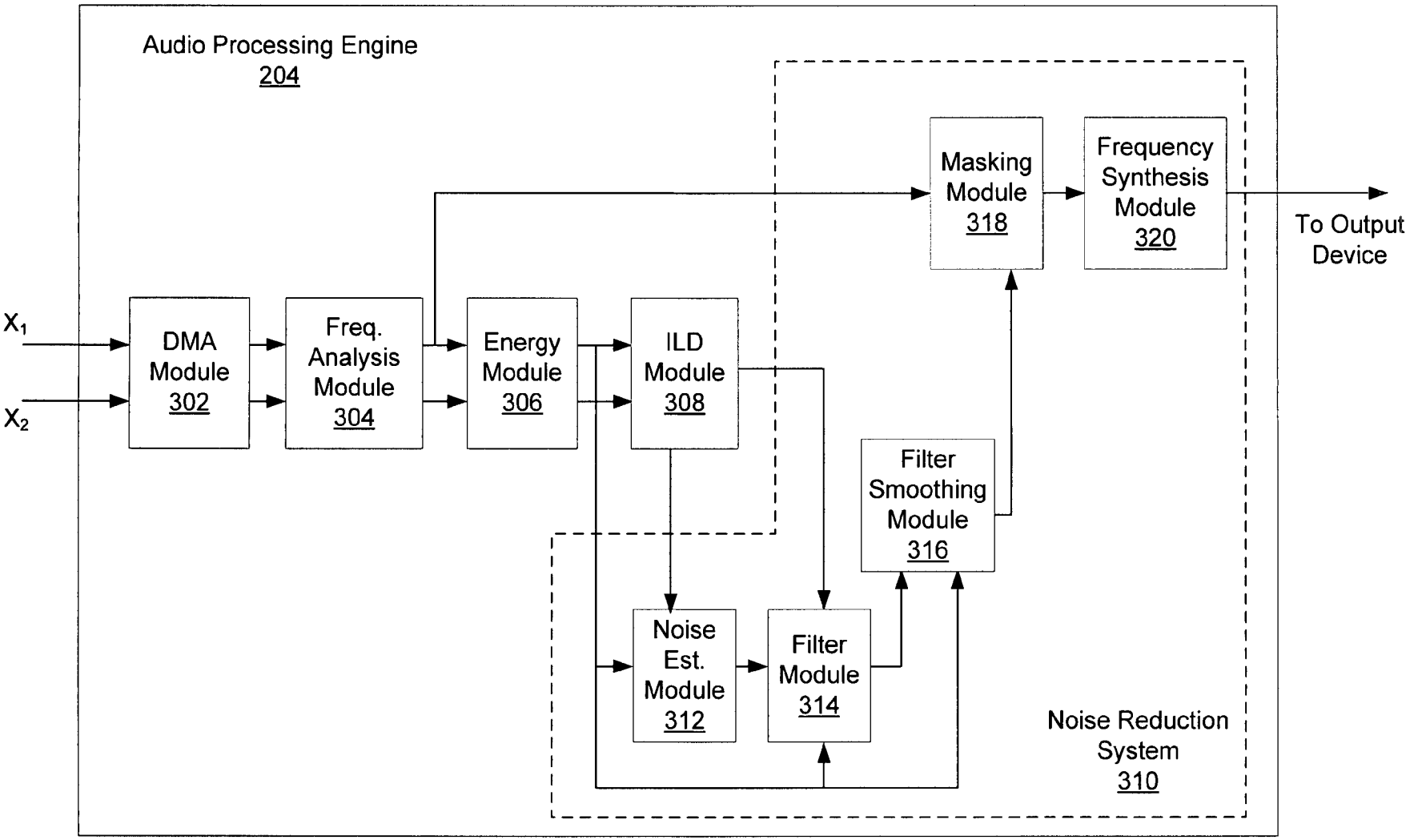
FIG. 3 is a block diagram of an exemplary audio processing engine.

FIG. 3 is a detailed block diagram of the exemplary audio processing engine 204, according to one embodiment of the present invention. In exemplary embodiments, the audio processing engine 204 is embodied within a memory device. In operation, the acoustic signals (i.e., $X_1$ and $X_2$) received from the primary and secondary microphones 106 and 108 are converted to electric signals and processed through a differential microphone array (DMA) module 302. The DMA module 302 is configured to use DMA theory to create directional patterns for the close-spaced microphones 106 and 108. The DMA module 302 may determine sounds and signals in a front and back cardioid region about the audio device 104 by delaying and subtracting the acoustic signals captured by the microphones 106 and 108. Signals (i.e., sounds) received from these cardioid regions are hereinafter referred to as cardioid signals. In one example, sounds from a audio source 102 within the cardioid region are transmitted by the primary microphone 106 as a cardioid primary signal. Sounds from the same audio source 102 are transmitted by the secondary microphone 108 as a cardioid secondary signal.

For a two-microphone system, the DMA module 302 can create two different directional patterns about the audio device 104. Each directional pattern is a region about the audio device 104 in which sounds generated by an audio source 102 within the region may be received by the microphones 106 and 108 with little attenuation. Sounds generated by audio sources 102 outside of the directional pattern may be attenuated.

In one example, one directional pattern created by the DMA module 302 allows sounds generated from an audio source 102 within a front cardioid region around the audio device 104 to be received, and a second pattern allows sounds from a second audio source 102 within a back cardioid region around the audio device 104 to be received. Sounds from audio sources 102 beyond these regions may also be received but the sounds may be attenuated.

The cardioid signals from the DMA module 302 are then processed by a frequency analysis module 304. In one embodiment the frequency analysis module 304 takes the cardioid signals and mimics the frequency analysis of the cochlea (i.e., cochlear domain) simulated by a filter bank. In one example, the frequency analysis module 304 separates the cardioid signals into frequency bands. Alternatively, other filters such as short-time Fourier transform (STFT), sub-band filter banks, modulated complex lapped transforms, cochlear models, wavelets, etc. can be used for the frequency analysis and synthesis. Because most sounds (e.g., acoustic signals) are complex and comprise more than one frequency, a sub-band analysis on the acoustic signal determines what individual frequencies are present in the complex acoustic signal during a frame (e.g., a predetermined period of time). In one embodiment, the frame is 8 ms long.

Once the frequencies are determined, the signals are forwarded to an energy module 306 which computes energy level estimates during an interval of time (i.e., power estimates). The power estimate may be based on bandwidth of the cochlea channel and the cardioid signal. The power estimates are then used by the inter-microphone level difference (ILD) module 308 to determine the ILD.

In various embodiments, the DMA module 302 sends the cardiod signals to the energy module 306. The energy module 306 computes the power estimates prior to the analysis of the cardiod signals by the frequency analysis module 304.

Figure 4A:
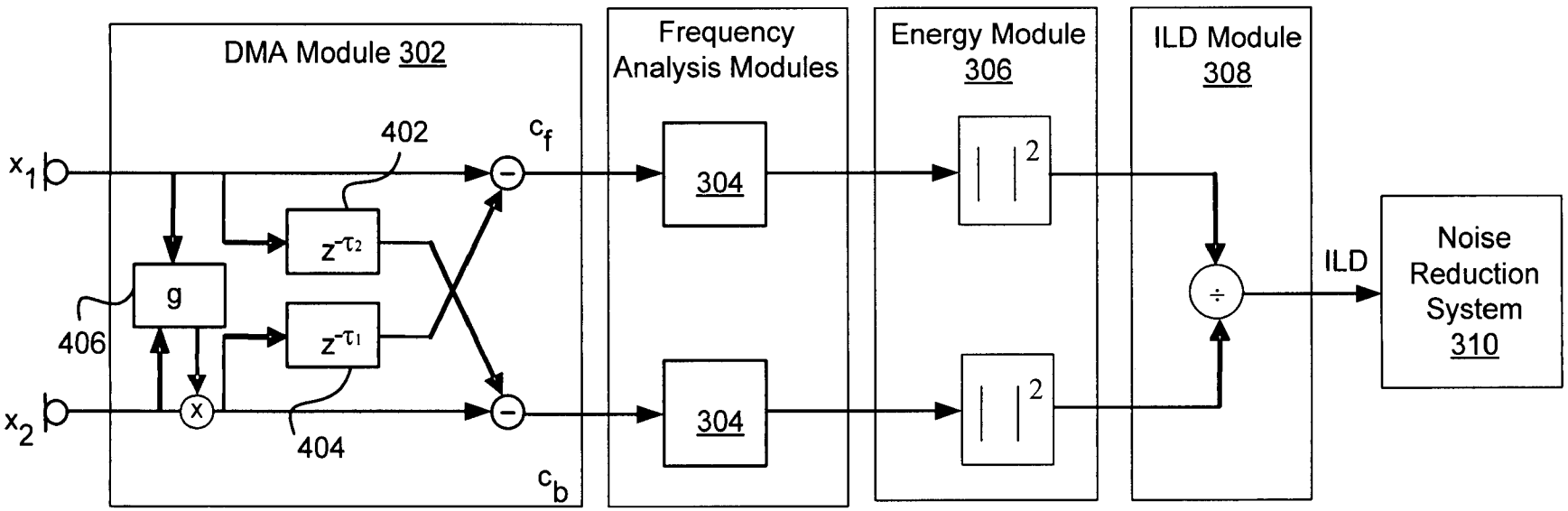
FIG. 4*a* illustrates an exemplary implementation of the DMA module, frequency analysis module, energy module, and the ILD module.
Figure 4B:
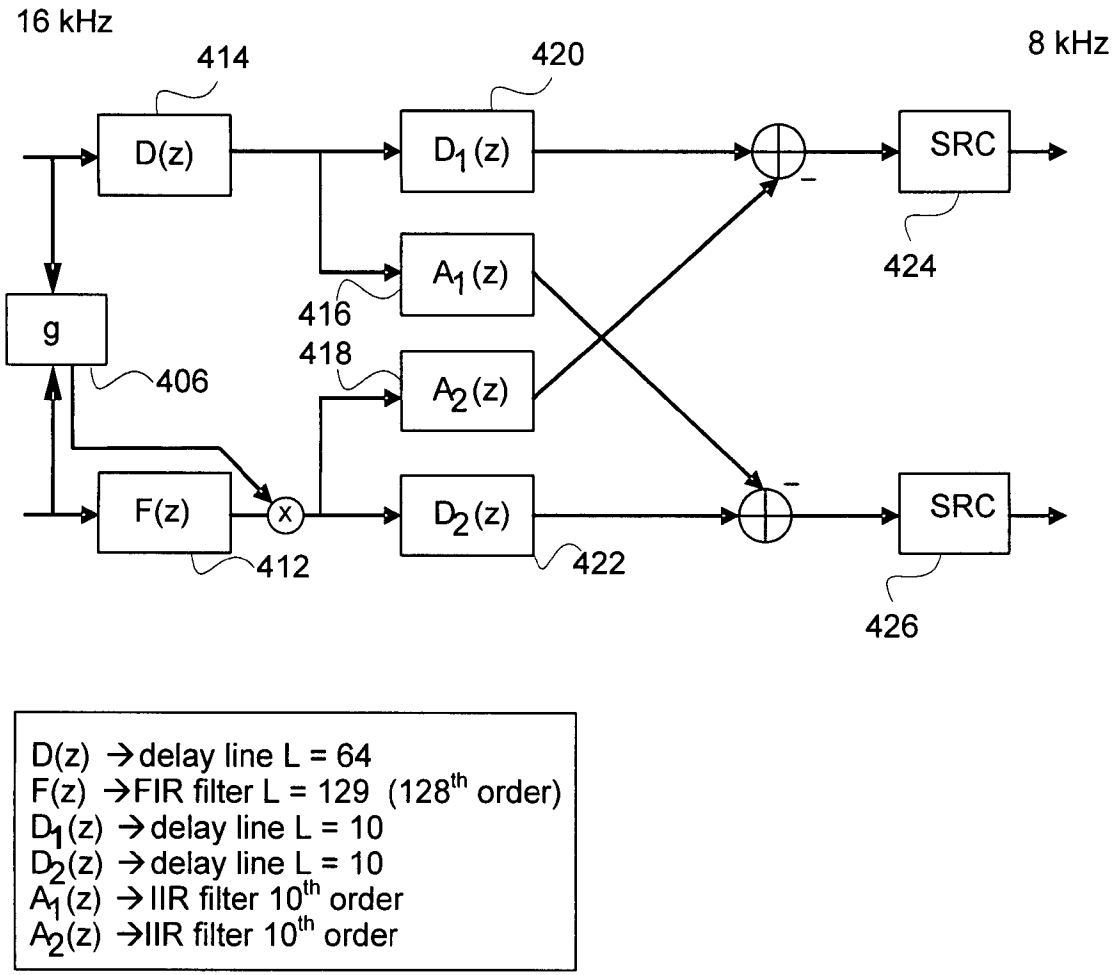
FIG. 4*b* is an exemplary implementation of the DMA module.

Referring to FIG. 4*a*, one implementation of the DMA module 302, frequency analysis module 304, energy module 306, and the ILD module 308 is provided. In this implementation, the acoustic signals received by the microphones 106 and 108 are processed by the DMA module 302. The exemplary DMA module 302 delays the primary acoustic signal, $X_1$, via a delay node 404, $z^{-\tau 1}$. Similarly, the DMA module 302 delays the secondary acoustic signal, $X_2$, via a second delay node 404, $z^{-\tau 2}$.

In exemplary embodiments, a cardioid primary signal ($C_f$) is mathematically determined in the frequency domain (Z transform) as $$C_f = X_1 - z^{-\tau 1} g X_2$$

while the cardioid secondary signal ($C_b$) is mathematically determined as $$C_b = g X_2 - z^{-\tau 2} X_1.$$

The gain factor, g, is computed by the gain module 406 to equalize the signal levels. Prior art systems can suffer loss of performance when the microphone signals have different levels. The gain module is further discussed herein.

In various embodiments, the cardioid signals can be processed through the frequency analysis module 304. The filter coefficient may be applied to each microphone signal. As a result, the output of the frequency analysis module 304 may comprise a filtered cardioid primary signal, $\alpha C_f(t,\omega)$ and a filtered cardioid secondary signal, $\beta C_f(t,\omega)$, where t represents the time index (t=0, 1, . . . N) and ω represents the frequency index (ω=0, 1, . . . K).

The energy module 306 takes the signals from the frequency analysis module 304 and calculates the power estimates associated with the cardioid primary signal ($C_f$) and the cardioid secondary signal ($C_b$). In exemplary embodiments, the power estimates may be mathematically determined by squaring and integrating an absolute value of the output of the frequency analysis module 304. Power estimates of the signals from the cardioid primary signal and the cardioid secondary signal are referred to herein as components. For example, the energy level associated with the primary microphone signal may be determined by $$E_f(t,\omega) = \int_{frame} |C_f(t',\omega)|^2 \, dt',$$

and the energy level associated with the secondary microphone signal may be determined by $$E_b(t,\omega) = \int_{frame} |C_b(t',\omega)|^2 \, dt'.$$

Given the calculated energy levels, the ILD may be determined by the ILD module 308. In exemplary embodiments, the ILD is determined in a non-linear manner by taking a ratio of the energy levels, such as $$ILD(t,\omega) = E_f(t,\omega)/E_b(t,\omega)$$

Applying the determined energy levels to this ILD equation results in $$ILD(t,\omega) = \frac{\int |C_f(t',\omega)|^2 \, dt'}{\int_{frame} |C_b(t',\omega)|^2 \, dt'}.$$

By nonlinearly combining the energy level (i.e., component) of the cardioid primary signal with the energy level (i.e., component) of the cardioid secondary signal, sounds from audio sources 102 within a front-to-back cardioid region (depicted in FIG. 6) about the audio device 104 may be effectively received. The spatial extent over which the signal can be retrieved can be specified and controlled by the ILD region selected. In contrast, if the cardioid primary signal and the cardioid secondary signal are combined linearly (e.g., the signals are subtracted,) sounds from audio sources 102 within a hypercardioid region may be effectively received. The hypercardioid region may be larger (broader) than the front-to-back cardioid ILD region selected, thus the non-linear combination via ILD can produce a narrower and more spatially selective beam.

Once the ILD is determined, the signals are processed through a noise reduction system 310. Referring back to FIG. 3, in exemplary embodiments, the noise reduction system 310 comprises a noise estimate module 312, a filter module 314, a filter smoothing module 316, a masking module 318, and a frequency synthesis module 320.

According to an exemplary embodiment of the present invention, a Wiener filter is used to suppress noise/enhance speech. In order to derive the Wiener filter estimate, however, specific inputs are needed. These inputs comprise a power spectral density of noise and a power spectral density of the primary acoustic signal.

In exemplary embodiments, the noise estimate is based only on the acoustic signal from the primary microphone 106. The exemplary noise estimate module 312 is a component which can be approximated mathematically by $$N(t,\omega) = \lambda_1(t,\omega) E_1(t,\omega) + (1-\lambda_1(t,\omega)) \min[N(t-1,\omega), E_1(t,\omega)]$$

according to one embodiment of the present invention. As shown, the noise estimate in this embodiment is based on minimum statistics of a current energy estimate of the primary acoustic signal, $E_1(t,\omega)$ and a noise estimate of a previous time frame, $N(t-1,\omega)$. As a result, the noise estimation is performed efficiently and with low latency.

$\lambda_1(t,\omega)$ in the above equation is derived from the ILD approximated by the ILD module 308, as $$\lambda_l(t,\omega) = \begin{cases} \approx 0 & \text{if } ILD(t,\omega) < \text{threshold} \\ \approx 1 & \text{if } ILD(t,\omega) > \text{threshold} \end{cases}$$

That is, when ILD at the primary microphone 106 is smaller than a threshold value (e.g., threshold=0.5) above which speech is expected to be, $\lambda_1$ is small, and thus the noise estimator follows the noise closely. When ILD starts to rise (e.g., because speech is present within the large ILD region), $\lambda_1$ increases. As a result, the noise estimate module 312 slows down the noise estimation process and the speech energy does not contribute significantly to the final noise estimate. Therefore, exemplary embodiments of the present invention may use a combination of minimum statistics and voice activity detection to determine the noise estimate.

A filter module 314 then derives a filter estimate based on the noise estimate. In one embodiment, the filter is a Wiener filter. Alternative embodiments may contemplate other filters. Accordingly, the Wiener filter may be approximated, according to one embodiment, as $$W = \left(\frac{P_s}{P_s + P_n}\right)^{\varphi},$$

where $P_s$ is a power spectral density of speech and $P_n$ is a power spectral density of noise. According to one embodiment, $P_n$ is the noise estimate, $N(t,\omega)$, which is calculated by the noise estimate module 312. In an exemplary embodiment, $P_s=E_1(t,\omega)-\gamma N(t,\omega)$, where $E_1(t,\omega)$ is the energy estimate associated with the primary acoustic signal (e.g., the cardioid primary signal) calculated by the energy module 306, and $N(t,\omega)$ is the noise estimate provided by the noise estimate module 312. Because the noise estimate changes with each frame, the filter-estimate will also change with each frame.

$\gamma$ is an over-subtraction term which is a function of the ILD. $\gamma$ compensates bias of minimum statistics of the noise estimate module 312 and forms a perceptual weighting. Because time constants are different, the bias will be different between portions of pure noise and portions of noise and speech. Therefore, in some embodiments, compensation for this bias may be necessary. In exemplary embodiments, $\gamma$ is determined empirically (e.g., 2-3 dB at a large ILD, and is 6-9 dB at a low ILD).

$\phi$ in the above exemplary Wiener filter equation is a factor which further limits the noise estimate. $\phi$ can be any positive value. In one embodiment, nonlinear expansion may be obtained by setting $\phi$ to 2. According to exemplary embodiments, $\phi$ is determined empirically and applied when a body of $$W = \left(\frac{P_s}{P_s + P_n}\right)$$

falls below a prescribed value (e.g., 12 dB down from the maximum possible value of W, which is unity).

Because the Wiener filter estimation may change quickly (e.g., from one frame to the next frame) and noise and speech estimates can vary greatly between each frame, application of the Wiener filter estimate, as is, may result in artifacts (e.g., discontinuities, blips, transients, etc.). Therefore, an optional filter smoothing module 316 is provided to smooth the Wiener filter estimate applied to the acoustic signals as a function of time. In one embodiment, the filter smoothing module 316 may be mathematically approximated as $$M(t,\omega)=\lambda_s(t,\omega)W(t,\omega)+(1-\lambda_s(t,\omega))M(t-1,\omega),$$

where $\lambda_s$ is a function of the Wiener filter estimate and the primary microphone energy, $E_1$.

As shown, the filter smoothing module 316, at time (t) will smooth the Wiener filter estimate using the values of the smoothed Wiener filter estimate from the previous frame at time (t−1). In order to allow for quick response to the acoustic signal changing quickly, the filter smoothing module 316 performs less smoothing on quick changing signals, and more smoothing on slower changing signals. This is accomplished by varying the value of $\lambda_s$ according to a weighed first order derivative of $E_1$ with respect to time. If the first order derivative is large and the energy change is large, then $\lambda_s$ is set to a large value. If the derivative is small then $\lambda_s$ is set to a smaller value.

After smoothing by the filter smoothing module 316, the primary acoustic signal is multiplied by the smoothed Wiener filter estimate to estimate the speech. In the above Wiener filter embodiment, the speech estimate is approximated by $S(t,\omega)=C_f(t,\omega)*M(t,\omega)$, where $C_f(t,\omega)$ is the cardioid primary signal. In exemplary embodiments, the speech estimation occurs in the masking module 318.

Next, the speech estimate is converted back into time domain from the cochlea domain. The conversion comprises taking the speech estimate, $S(t,\omega)$, and adding together the phase shifted signals of the cochlea channels in a frequency synthesis module 320. Once conversion is completed, the signal is output to the user.

It should be noted that the system architecture of the audio processing engine 204 of FIG. 3 is exemplary. Alternative embodiments may comprise more components, less components, or equivalent components and still be within the scope of embodiments of the present invention. Various modules of the audio processing engine 204 may be combined into a single module. For example, the functionalities of the frequency analysis module 304 and energy module 306 may be combined into a single module. Furthermore, the functions of the ILD module 308 may be combined with the functions of the energy module 306 alone, or in combination with the frequency analysis module 304. As a further example, the functionality of the filter module 314 may be combined with the functionality of the filter smoothing module 316.

Referring now to FIG. **4*b*, a practical implementation of the DMA module 302 according to one embodiment of the present invention is shown. In exemplary embodiments, microphone differences are compensated by using a filter 412, F(z), that equalizes the microphones 106 and 108. Since the filter 412 is a non-causal filter, in some embodiments, a delay is applied to the primary microphone signal with a delay node 414, D(z). The application of the delay node 414** results in an alignment of the two channels.

To implement a fractional delay, allpass filters 416 and 418 (e.g., $A_1(z)$ and $A_2(z)$) are applied to the signals. However, the application of the allpass filters 416 and 418 introduces a delay. As a result, two more delay nodes 420 and 422 (e.g., $D_1(z)$ and $D_2(Z)$) are required.

A secondary acoustic signal magnitude may be modified to match a magnitude of the primary acoustic signal by applying a gain which is computed by the gain module 406. The gain module 406 computes the magnitude of both signals (e.g., $X_1$ and $X_2$) and derives the gain, g, as the ratio between the magnitude of the primary acoustic signal to the magnitude of the secondary acoustic signal. The gain can then be used to calculate the cardioid primary signal and the cardioid secondary signal.

Since the allpass filters 416 and 418 produce a desired fractional delay up to one-half the Nyquist frequency, the processing is applied at twice the system sampling rate.

As a result, sampling rate conversion (SRC) nodes 424 and 426 is provided. The outputs of the SRC nodes 424 and 426 are the cardioid primary and cardioid secondary signals, $C_f$ and $C_b$.

Figure 5:
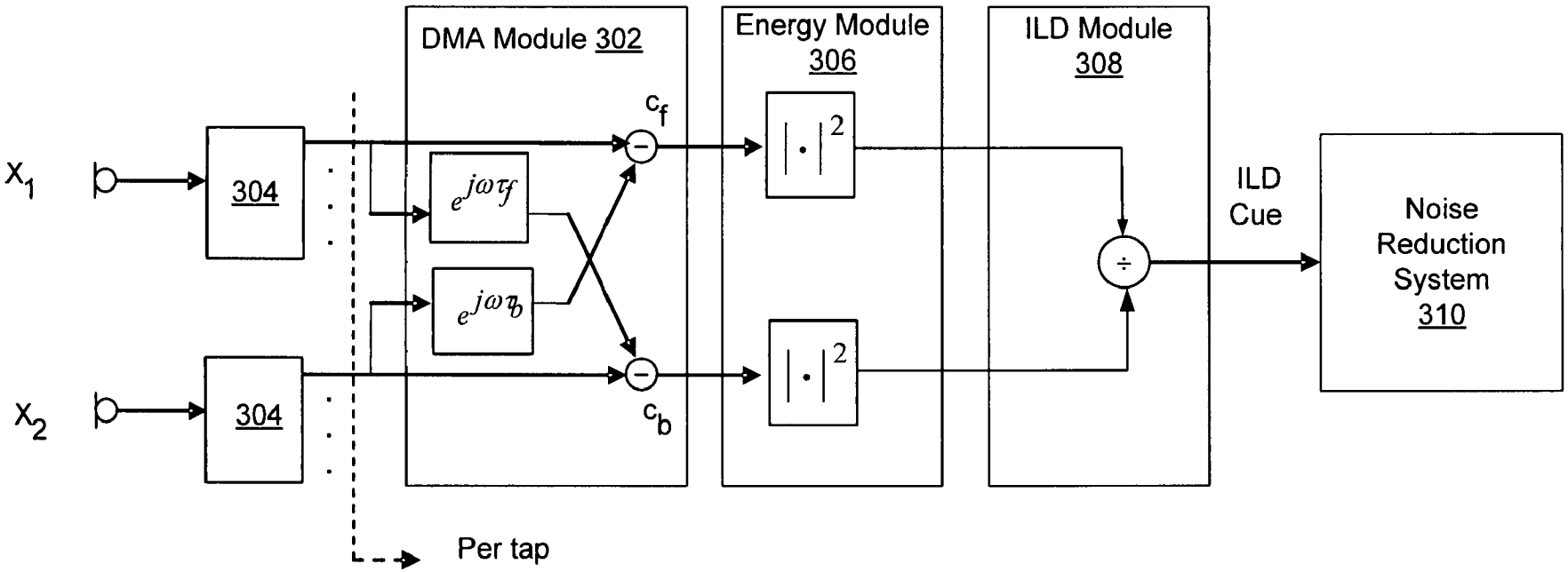
FIG. 5 is a block diagram of an alternative embodiment of the present invention.

FIG. 5 is a block diagram of an alternative embodiment of the present invention. In this embodiment, the acoustic signals from the microphones 106 and 108 are processed by a frequency analysis module 304 prior to processing by a DMA module 302. According to the present embodiment, the frequency analysis module 304 takes the acoustic signals (i.e., $X_1$ and $X_2$) and mimics a cochlea implementation using a filter bank, such as a fast Fourier transform. Alternatively, other filters such as short-time Fourier transform (STFT), sub-band filter banks, modulated complex lapped transforms, cochlear models, wavelets, etc. can be used for the frequency analysis and synthesis. The output of the frequency analysis module 304 may comprise a plurality of signals (e.g., one per sub-band or tap.)

The secondary acoustic signal magnitude is modified to match the magnitude of the primary acoustic signal by computing the magnitude of both signals and deriving the gain, g, as the ratio between the magnitude of the primary acoustic signal to the magnitude of the secondary acoustic signal. Subsequently, the signals may be processed through the DMA module 302. In the present embodiment, phase shifting of the signals (e.g., using $e^{j\omega\tau_f}$) is utilized to achieve a fractional delay of the signals.

The remainder of the process through the energy module 306 and the ILD module 308 is similar to the process described in connection with FIG. 4*a*, but on a per sub-band or tap basis.

Figure 6:
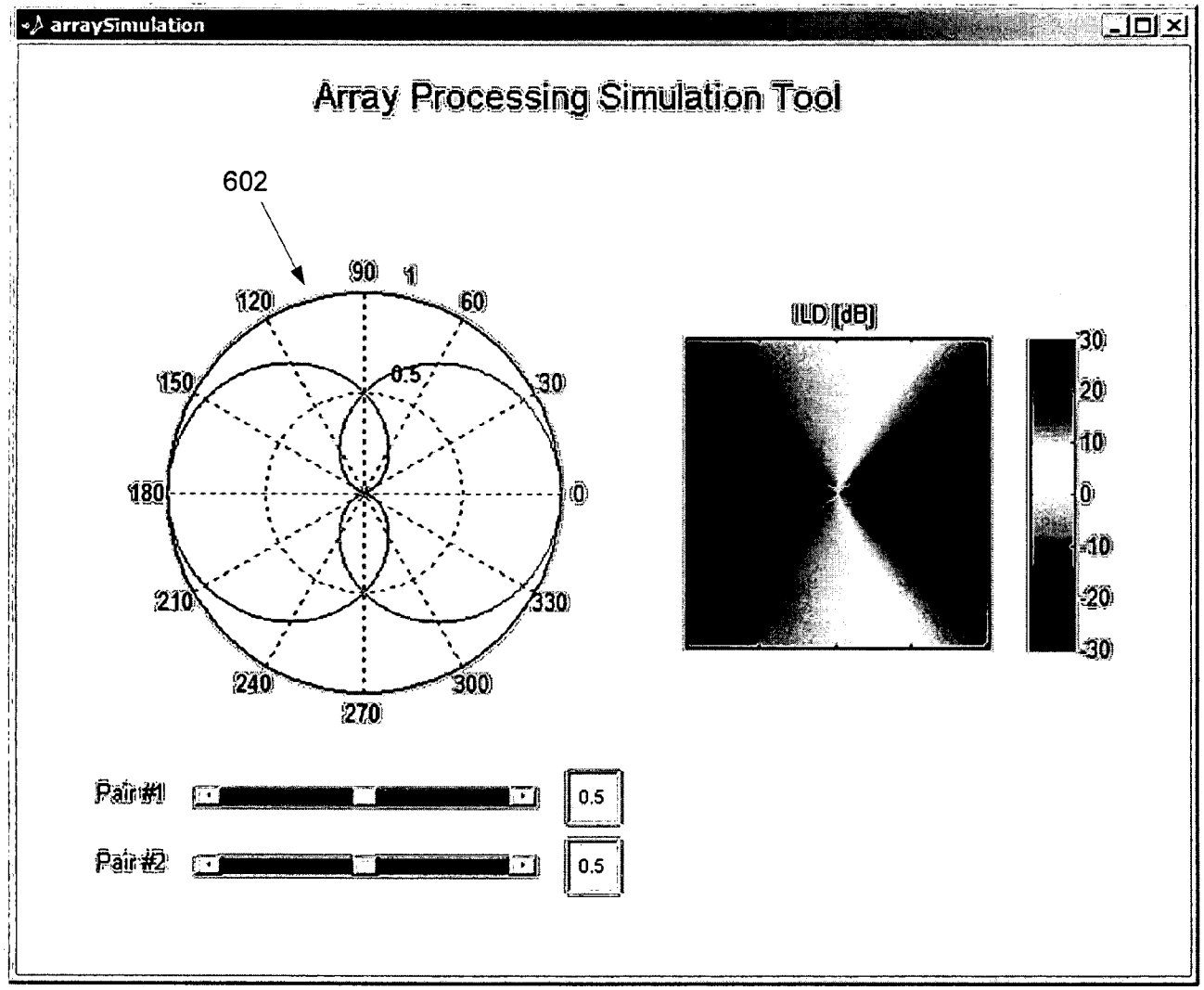
FIG. 6 is a polar plot of a front-to-back cardioid directivity pattern and ILD diagram produced according to embodiments of the present invention.

FIG. 6 is a polar plot of a front-to-back cardioid directivity pattern 602 and ILD diagram produced according to exemplary embodiments of the present invention. The cardioid directivity pattern 602 illustrates a range in which the acoustic signals may be received. As shown, by using the non-linear combination process and delay nodes (e.g., 420 and 422), the range of the cardioid directivity pattern 602 may be extended in the forward and backward directions (i.e., along the x-axis). The extension in the forward and backward directions allows significant ILD cues to be obtained from acoustic sources further away from the microphones 106 and 108. As a result, the omni-directional microphones 106 and 108 can achieve acoustic characteristics that mimic those of directional microphones.

Figure 7:
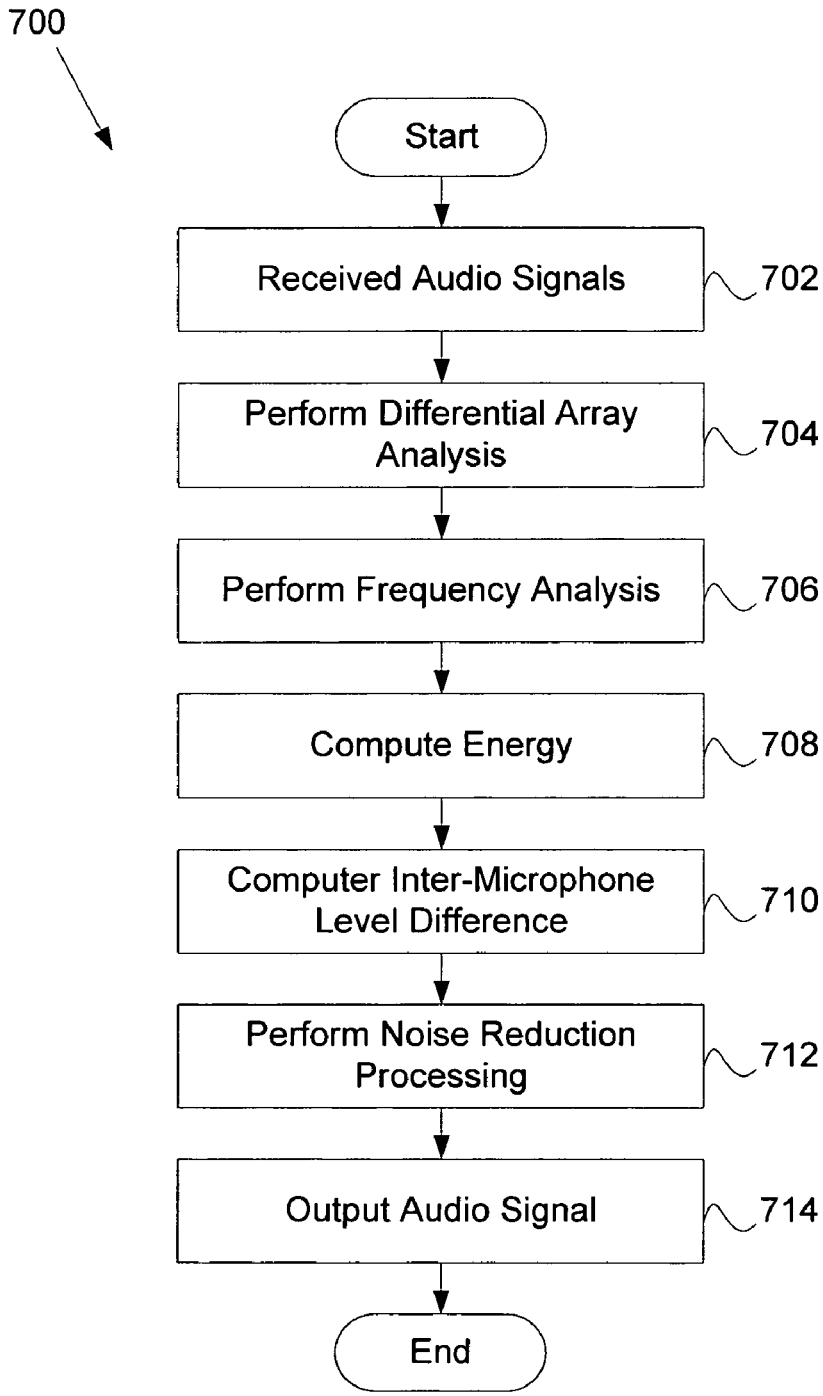
FIG. 7 is a flowchart of an exemplary method for utilizing ILD of omni-directional microphones for speech enhancement.

Referring now to FIG. 7, a flowchart 700 of an exemplary method for utilizing ILD of omni-direction microphones for noise suppression and speech enhancement is shown. In step 702, acoustic signals are received by the primary microphone 106 and the secondary microphone 108. In exemplary embodiments, the microphones are omni-directional microphones. In some embodiments, the acoustic signals are converted by the microphones to electronic signals (i.e., the primary electric signal and the secondary electric signal) for processing.

Differential array analysis is then performed in step 704 on the acoustic signals by the DMA module 302. In exemplary embodiments, the DMA module 302 is configured to determine the cardioid primary signal and the cardioid secondary signal by delaying, subtracting, and applying a gain factor to the acoustic signals captured by the microphones 106 and 108. Specifically, the DMA module 302 determines the cardioid primary signal by taking a difference between the primary electric signal and a delayed secondary electric signal. Similarly, the DMA module 302 determines the cardioid secondary signal by taking a difference between the secondary electric signal and a delay primary electric signal.

In step 706, the frequency analysis module 304 performs frequency analysis on the cardioid primary and secondary signals. According to one embodiment, the frequency analysis module 304 utilizes a filter bank to determine individual frequencies present in the complex cardioid primary and secondary signals.

In step 708, energy estimates for the cardioid primary and secondary signals are computed. In one embodiment, the energy estimates are determined by the energy module 306. The exemplary energy module 306 utilizes a present cardioid signal and a previously calculated energy estimate to determine the present energy estimate of the present cardioid signal.

Once the energy estimates are calculated, inter-microphone level differences (ILD) are computed in step 710. In one embodiment, the ILD is calculated based on a non-linear combination of the energy estimates of the cardioid primary and secondary signals. In exemplary embodiments, the ILD is computed by the ILD module 308.

Once the ILD is determined, the cardioid primary and secondary signals are processed through a noise reduction system in step 712. Step 712 will be discussed in more detail in connection with FIG. 8. The result of the noise reduction processing is then output to the user in step 714. In some embodiments, the electronic signals are converted to analog signals for output. The output may be via a speaker, earpieces, or other similar devices.

Figure 8:
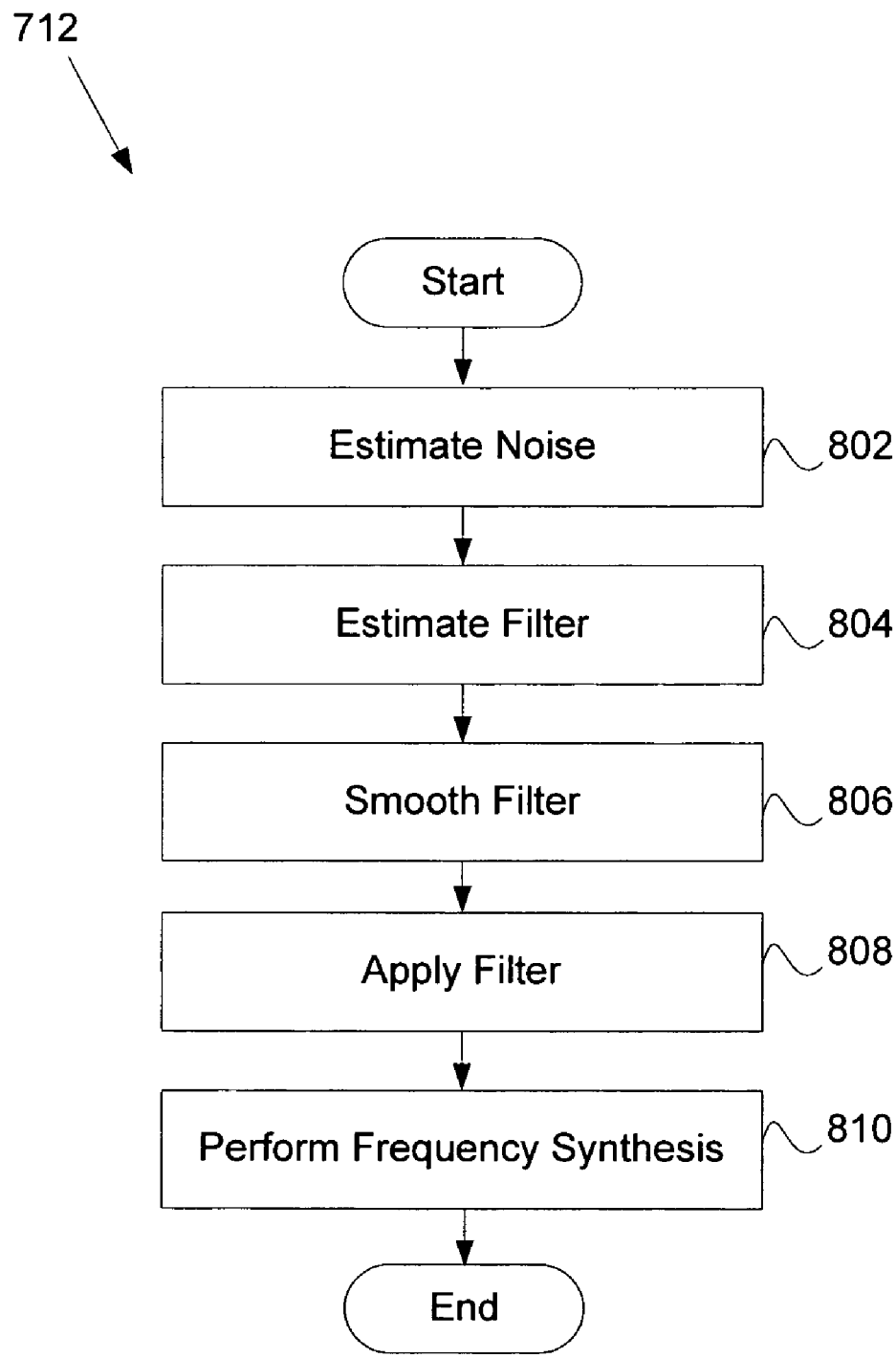
FIG. 8 is a flowchart of an exemplary noise reduction process.

Referring now to FIG. 8, a flowchart of the exemplary noise reduction process (step 712) is provided. Based on the calculated ILD, noise is estimated in step 802. According to embodiments of the present invention, the noise estimate is based only on the acoustic signal received at the primary microphone 106. The noise estimate may be based on the present energy estimate of the acoustic signal from the primary microphone 106 and a previously computed noise estimate. In determining the noise estimate, the noise estimation is frozen or slowed down when the ILD increases, according to exemplary embodiments of the present invention.

In step 804, a filter estimate is computed by the filter module 314. In one embodiment, the filter used in the audio processing engine 208 is a Wiener filter. Once the filter estimate is determined, the filter estimate may be smoothed in step 806. Smoothing prevents fast fluctuations which may. create audio artifacts. The smoothed filter estimate is applied to the acoustic signal from the primary microphone 106 in step 808 to generate a speech estimate.

In step 810, the speech estimate is converted back to the time domain. Exemplary conversion techniques apply an inverse frequency of the cochlea channel to the speech estimate. Once the speech estimate is converted, the audio signal may now be output to the user.

The above-described modules can be comprised of instructions that are stored on storage media. The instructions can be retrieved and executed by the processor 202. Some examples of instructions include software, program code, and firmware. Some examples of storage media comprise memory devices and integrated circuits. The instructions are operational when executed by the processor 202 to direct the processor 202 to operate in accordance with embodiments of the present invention. Those skilled in the art are familiar with instructions, processor(s), and storage media.

The present invention is described above with reference to exemplary embodiments. It will be apparent to those skilled in the art that various modifications may be made and other embodiments can be used without departing from the broader scope of the present invention. Therefore, these and other variations upon the exemplary embodiments are intended to be covered by the present invention.

The invention claimed is:

1. A system for enhancing speech, comprising:

a primary and secondary microphone configured to receive a primary acoustic signal and a secondary acoustic signal;

a differential microphone array (DMA) module configured to determine a cardioid primary signal and a cardioid secondary signal based on a primary electric signal converted from the primary acoustic signal and secondary electric signal converted from the secondary acoustic signal, the differential microphone array module being further configured to determine the cardioid primary signal based at least in part on delaying at least one of the primary electric signal and the secondary electric signal; and an inter-microphone level difference module configured to non-linearly combine components of the cardioid primary signal and the cardioid secondary signal to obtain an inter-microphone level difference.

2. The system of claim 1 wherein the DMA module is configured to determine the cardioid primary signal by taking a difference between a delayed primary electric signal and a delayed and level-equalized secondary electric signal.

3. The system of claim 1 wherein the DMA module is configured to determine the cardioid primary signal by determining a gain and taking a difference between a primary electric signal and a delayed secondary electric signal adjusted by the gain.

4. The system of claim 3 wherein the gain is the ratio between a magnitude of the primary acoustic signal and a magnitude of the secondary acoustic signal.

5. The system of claim 1 wherein the DMA module is configured to determine the cardioid secondary signal by taking a difference between the secondary electric signal and a delayed primary electric signal.

6. The system of claim 1 further comprising a frequency analysis module configured to determine frequencies for the cardioid primary signal and the cardioid secondary signal.

7. The system of claim 1 further comprising an energy module configured to determine energy estimates for a frame of the cardioid primary signal and the cardioid secondary signal.

8. The system of claim 1 further comprising a noise estimate module configured to determine a noise estimate for the primary acoustic signal based on an energy estimate of the cardioid primary signal and the inter-microphone level difference.

9. The system of claim 1 further comprising a filter module configured to determine a filter estimate to be applied to the primary acoustic signal.

10. The system of claim 9 further comprising a filter smoothing module configured to smooth the filter estimate prior to applying the filter estimate to the primary acoustic signal.

11. The system of claim 1 further comprising a masking module configured to determine a speech estimate.

12. The system of claim 11 further comprising a frequency synthesis module configured to convert the speech estimate into a time domain for output.

13. The system of claim 1, wherein the DMA module determines the cardioid primary signal and a cardioid secondary signal of a sub-band of the primary electric signal.

14. The system of claim 1 wherein the DMA module is configured to determine the cardioid secondary signal by taking a difference between a level-equalized secondary electric signal and a delayed primary electric signal.

15. A method for enhancing speech, comprising:

receiving a primary acoustic signal at a primary microphone and a secondary acoustic signal at a secondary microphone;

determining a cardioid primary signal and a cardioid secondary signal based on a primary electric signal converted from the primary acoustic signal and a secondary electric signal converted from the secondary acoustic signal;

determining the cardioid primary signal further based at least in part on delaying at least one of the primary electric signal and the secondary electric signal; and non-linearly combining components of the cardioid primary signal and cardioid secondary signal to obtain an inter-microphone level difference.

16. The method of claim 15 wherein determining the cardioid primary signal comprises taking a difference between a delayed primary electric signal and a delayed secondary electric signal.

17. The method of claim 15 wherein determining the cardioid primary signal comprises determining a gain and taking a difference between a primary electric signal and a delayed secondary electric signal adjusted by the gain.

18. The method of claim 17 wherein the gain is the ratio between a magnitude of the primary acoustic signal and a magnitude of the secondary acoustic signal.

19. The method of claim 15 wherein determining the cardioid secondary signal comprises taking a difference between the secondary electric signal and a delayed primary electric signal.

20. The method of claim 15 wherein non-linearly combining comprises dividing the component of the cardioid primary signal by the component of the cardioid secondary signal.

21. The method of claim 15 further comprising determining an energy estimate for each of the acoustic signals during a frame.

22. The method of claim 15 further comprising determining a noise estimate based on an energy estimate of the primary acoustic signal and the inter-microphone level difference.

23. The method of claim 22 further comprising determining a filter estimate based on the noise estimate of the primary acoustic signal, the energy estimate of the primary acoustic signal, and the inter-microphone level difference.

24. The method of claim 23 further comprising producing a speech estimate by applying the filter estimate to the primary acoustic signal.

25. The method of claim 23 further comprising smoothing the filter estimate.

26. The method of claim 15 wherein the cardioid primary signal and the cardioid secondary signal are each of a sub-band of the primary electric signal.

27. The method of claim 15 wherein determining the cardioid primary signal comprises taking a difference between a delayed primary electric signal and a level-equalized secondary electric signal.

28. A non-transitory computer readable storage medium having embodied thereon a program, the program being executable by a processor to perform a method for enhancing speech, the method comprising:

receiving a primary acoustic signal at a primary microphone and a secondary acoustic signal at a secondary microphone;

determining a cardioid primary signal and a cardioid secondary signal based on a primary electric signal converted from the primary acoustic signal and a secondary electric signal converted from the secondary acoustic signal;

determining the cardioid primary signal further based at least in part on delaying at least one of the primary electric signal and the secondary electric signal; and non-linearly combining components of the cardioid primary signal and the cardioid secondary signal to obtain an inter-microphone level difference.

* * * * *